United States Patent [19]

Kawaguchi

[11] 4,271,641

[45] Jun. 9, 1981

[54] TENSION STRUCTURE

[75] Inventor: Mamoru Kawaguchi, Tokyo, Japan

[73] Assignee: Taiyo Kogyo Company Limited, Tokyo, Japan

[21] Appl. No.: 12,739

[22] Filed: Feb. 16, 1979

[30] Foreign Application Priority Data

Mar. 6, 1978 [JP] Japan ..... 53-244484
Mar. 15, 1978 [JP] Japan ..... 53-28595

[51] Int. Cl.[3] ..... E04B 1/34

[52] U.S. Cl. ..... 52/2; 52/80; 52/83

[58] Field of Search ..... 52/2, 80, 83

[56] References Cited

U.S. PATENT DOCUMENTS

| | | | |
|---|---|---|---|
| 2,355,248 | 8/1944 | Stevens, Jr. | 52/2 |
| 2,649,101 | 8/1953 | Suits | 52/2 |
| 2,881,718 | 4/1959 | Stromeyer | 52/83 X |
| 3,113,403 | 12/1963 | MacMillan, Jr. et al. | 52/2 |
| 3,123,085 | 3/1964 | Demarteau | 52/2 |
| 3,240,217 | 3/1966 | Bird et al. | 52/2 X |
| 3,373,531 | 3/1968 | Meyer et al. | 52/2 |
| 3,410,039 | 11/1968 | Brezina | 52/80 |
| 3,638,368 | 2/1972 | Pierson | 52/80 X |
| 3,842,550 | 10/1974 | Duquette | 52/2 |
| 4,130,969 | 12/1978 | Ivanov | 52/80 |
| 4,146,996 | 4/1979 | Arnesen | 52/2 |

FOREIGN PATENT DOCUMENTS

| | | | |
|---|---|---|---|
| 222641 | 7/1968 | U.S.S.R. | 52/80 |
| 375365 | 6/1973 | U.S.S.R. | 52/83 |

OTHER PUBLICATIONS

Nickel Stainless Steel Membrane Structures, a publication of The International Nickel Co. of Canada, Ltd, 24 pp.

Tension Structures and Space Frames, pp. 40–45, Published by the Architectural Institute of Japan, 1972.

Tensile Structures, vol. I, pp. 36–39 & 110–115, Published by the M.I.T. Press 1967.

Air Supported Roofs for Factories, Architectural Record, pp. 45, 46, Dec. 1942.

A Roof that Floats on Air, Sheet Metal Worker, Jul. 1945, pp. 41, 42.

*Primary Examiner*—Alfred C. Perham

*Attorney, Agent, or Firm*—Armstrong, Nikaido, Marmelstein & Kubovcik

[57] ABSTRACT

A tension structure having a curved surface comprises a group of metal strips to form the curved surface and each of the strips is pre-stressed under tension for stabilizing the structure. The tension is produced in the strips by a group of tension members generally having a curvature opposite to that of the strips, the strips and tension members being arranged to effect tension indirectly on each other through an intermediate means such as a group of intermediate members disposed therebetween or air serving as the intermediate means or directly. In some instances, the ground surface regarded as having an indefinite radius is utilized as equivalent to the tension members. The erection of the structure is available by the application of tension and the conventional scaffold usually required may be omitted.

12 Claims, 25 Drawing Figures

TENSION STRUCTURE

FIELD OF THE INVENTION

The present invention is related to a tension structure and, particularly to a tension structure having a curved metal surface comprising plural metal strips each of which is prestressed and acts as a resisting member of the structure.

BACKGROUND OF THE INVENTION

It has been practiced to employ a tension structure to cover a large space such as a gymnasium, exhibiting pavilion, assembly hall, plant, cooling tower, or large roof and/or wall the examples of which are disclosed in "Tension Structures and Space Frames" by Y. Yokoo et al published in 1972 by the Architectural Institute of Japan.

In constructing such a large space structure, roof or wall, it has been customary to install panel members over a braced grid or network structure comprising tension members such as wire ropes, steel frames, etc. Sometimes, a membrane may be stretched over such base frames as listed above.

However, aerial operation and/or a large scaffold have been necessary to erect such a braced grid or network structure which resulted in the drawbacks in safety and efficiency regarding the aerial operation and expensiveness regarding the necessary scaffold. Further, as touched upon above, an additional operation of installing panels or stretching a membrane is required after the erection of the frame structure.

Also, for almost the same purpose as that of the structures touched upon above, a pneumatic membrane structure has been employed such as disclosed in "Pneumatic Structures" by Frei Otto in Vol. 1 of "Tensil Structures" published by Ullstein Verlag GmbH, Frankfurt/M-Berlin. The erection of such a pneumatic structure requires neither a large scaffold nor an additional operation for installing panels or the like except for supplying pneumatic pressure to keep the pressure difference between the inside and the outside of the structure. The materials employed in the pneumatic structure are generally canvas, woven synthetic fibers or woven glass fibers coated with synthetic resin and they are used as membranes and such membrane is stretched to form a desired shape by applying pneumatic pressure and maintaining the internal pressure above the atmospheric pressure. The woven materials referred to above are generally combustible or inflammable and the glass fibers are easily fusible under high temperature. Therefore, the materials conventionally used for the pneumatic membrane structures are inferior against fire or flying sparks. Also, they deteriorate under natural conditions, such as exposure to ultraviolet rays and, the materials made of or comprising high polymers are subject to so-called "creep", and so they are not suitable for maintaining stable shapes and mechanical properties. Therefore, the conventional pneumatic structures have never been suitable for permanent or semi-permanent constructions.

Accordingly, it has been desired to have a structure which is free from the above drawbacks.

SUMMARY OF THE INVENTION

Therefore, it is an object of this invention to provide an economical structure suitable for permanent or semi-permanent usage to completely or partially protect and/or enclose a relatively large space.

It is a further object of this invention to provide a structure which substantially does not require an aerial operation and/or a large scaffold in construction thereof.

It is another object of this invention to provide such a structure as stated above wherein the outer surface member is of metal sheet stretched easily at the time of construction of the structure without need of further operation for installing panels, etc. constituting wall or roofing members.

It is still another object of this invention to provide a structure satisfying the above objects and being able to be erected pneumatically.

According to the present invention, the above objects are satisfactorily attained.

The structure constructed according to the present invention employs a group of metal sheets or strips as exterior surface members or skins thereof which are pre-stressed in tension.

The pre-stressed strips act to serve as resisting members, in addition to their ordinary protective surface members, to maintain the rigidity and stability of the structure and to withstand wind, rain, snow or earthquake.

Tension is applied to each of the surface members or strips in a direction substantially parallel to the longitudinal direction of the strip, i.e. the rolling direction of the strip. To apply tension to each of the group of metal strips, there are generally arranged a group of tension members coupled with the group of strips through intermediate members disposed therebetween. The strips, tension members and the intermediate members are arranged to interact with each other to maintain the stressed situation of the strips, the tension members being also placed under tensile stress. The strips and the tension members under the above condition are caused to form a curved outer skin surface the curvature of which is generally opposite to that of the group of tension members. When the term "opposite" is employed regarding the curvature in the present specification and claims it refers to the situation in which the center of curvature is oppositely located regarding the surface or skin. In some of the embodiments of the present invention, the intermediate members may be omitted. Further, the intermediate members may be replaced by pneumatic means—air—when the structure is designed as similar to a pneumatic membrane structure. Also, when the pneumatic membrane system is employed, the tension members may be replaced with another means such as ground having an indefinite radius of curvature in some instances.

Since the outer surface members or skins are made of metal, they also provide durability under the various weather conditions.

As touched upon above, each of the strips is placed substantially only under tension; there is substantially no necessity to join the adjacent strips with each other except for such case as when the strips themselves are used to seal the pneumatic pressure or there is necessity such as to prevent rain from entering inside. The erection of the structure according to the present invention is just to apply the tension to the strips (and the tension members) whereby the manufacturing and erection thereof are performed very easily and economically by saving materials and eliminating several operations and the large scaffold heretofore required in the construction of similar structures.

The objects and advantages of the present invention not touched upon in the foregoing will be further clarified in connection with the detailed description of the preferred embodiments of the present invention which follows the brief description of the drawings below.

BRIEF DESCRIPTION OF THE DRAWINGS

FIGS. 1B and 1C are fractional illustration of portions showing an example of means for connecting concerned members of the embodiment shown in FIG. 1A wherein FIG. 1C is a cross section as viewed along the line IC—IC in FIG. 1B;

FIGS. 2C, 2D and 2E illustrate partially an example of practical connections applicable to the structure shown in FIGS. 2A and 2B wherein FIG. 2C is a cross section taken along the line IIC—IIC in FIG. 2A and FIGS. 2D and 2E are cross sections viewed along the lines IID—IID and IIE—IIE in FIG. 2C, respectively;

FIGS. 3C and 3D indicate partially a connection of a strip to a frame as an example for use in the third embodiment wherein FIG. 3C is a cross section taken along the line IIIC—IIIC in FIG. 3A, FIG. 3D is a view taken along the line IIID—IIID in FIG. 3C;

DETAILED DESCRIPTION OF THE PREFERRED EMBODIMENTS

Figure 1A:
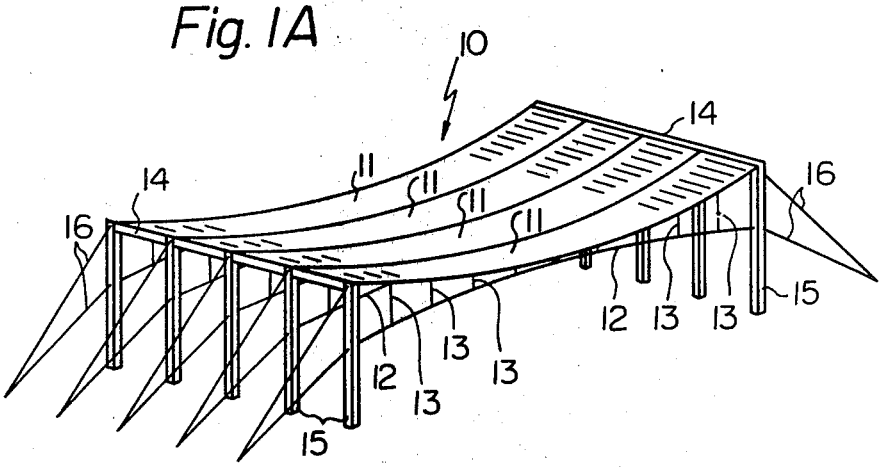
FIG. 1A is a perspective view of a preferred embodiment of the present invention.

Referring to FIG. 1A, there is illustrated one of the preferred embodiments of the present invention in which the structure constructed is utilized as a roof 10 having a generally rectangular configuration. The top surface thereof consists of a group of sheet metal strips 11 arranged parallel to each other. The strips 11 are, for example, of steel, stainless steel or aluminum alloy sheet having a desired thickness.

A group of tension members, in this case wires 12, having curvature opposite to the strips 11 is arranged under the strips 11 and plural intermediate members 13 are disposed between the two groups (11 and 12). The opposite ends of strips 11 are secured to rigid boundary members 14, respectively. Also, the opposite ends of tension wires 12 are secured to plural posts 15 as shown. Under such construction explained above, if tension is applied to either the strips 11 or wires 12 or the both, the strips 11 and wires 12 are caused to have mutual effect on each other through the intermediate members 13 and are pre-stressed to the extent that the whole structure becomes stable and maintains its shape so as to withstand wind pressure or load imposed by snow or earthquake. The tension may be applied to the structure of the roof 10, for example, by stretching ropes 16 between the members 14 and the ground. Or, strips 11 and tension members may be secured to the members 14 and 15, respectively, through appropriate fittings such as turnbuckles whereby tension is applied by adjusting such fittings. In the illustrated embodiment, wires 13 are employed as tension members; however, it is available to select one from several materials such as wire rope, iron or steel rod, etc. Also, the wide selection of materials for the intermediate members is available including metals and non-metallic materials. Employment of tubes may be helpful to reduce the weight of the structure.

As illustrated, the length of each of the intermediate members is adjusted so as to keep the proper configuration of the strips 11 and tension members 12 under tension.

Figure 1C:
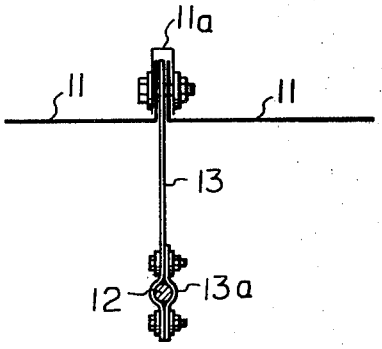
Figure 1B:
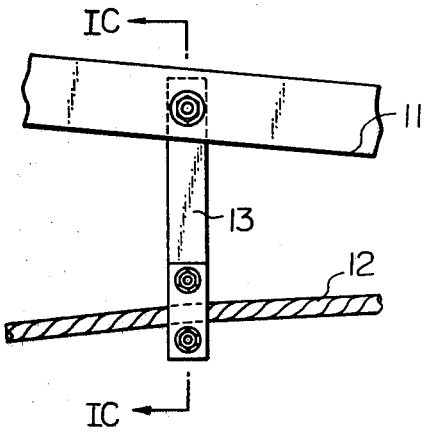

The strips 11 may overlap each other along their edges or may be joined together with mechanical means there. Any convenient way of joining the members may be used. By way of example, mechanical joining means is illustrated in FIGS. 1B and 1C. In these illustrations, the respective edges of the strips 11 are given flanges bent upwardly and the flanges are secured together with a covering member **11*a* and the intermediate members 13 by fastening means such as bolts and nuts. Also, each lower end of the intermediate members 13 is coupled with the corresponding tension member 12 by a plate 13*a* and fastening means such as bolts and nuts, the tension member 12 being clamped by the member 13 and the plate 13*a*. In the joining construction illustrated in FIGS. 1B and 1C, difficulty may be encountered in making the upright flanges of the strips 11 and covering members 11*a* conform to the curved surface as illustrated in FIG. 1A and, to eliminate such a problem, a suitable number of cutouts or corrugations may be provided with an appropriate pitch along the longitudinal direction. The covering member 11*a* need not necessarily be metal and flexible tapes may also be used for the same purpose as the covering member 11*a***. In the illustrations, the flanges were bent upwardly; however, they may be bent downwardly.

Figure 2A:
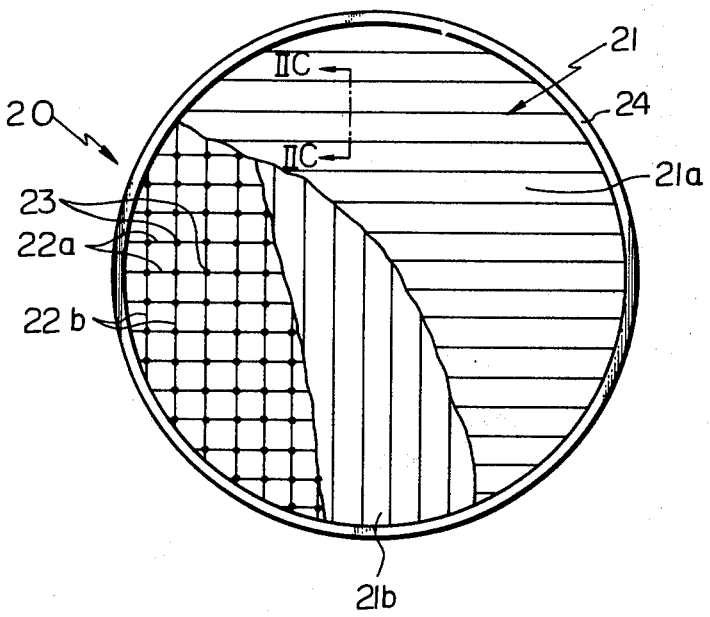
FIGS. 2A and 2B show a second embodiment of the present invention in a plan view and a side view, respectively.
Figure 2B:
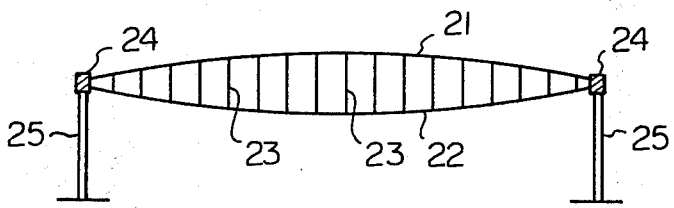

In FIGS. 2A and 2B, there are shown a plan view and a side view, respectively, of another embodiment of the present invention which is applied to a roof 20 of a circular plan. In the roof 20, a top surface 21 and lower tension grid 22 are secured to a circular rigid ring 24 by any suitable means so that they are placed under tension with each other through a plurality of intermediate members 23.

The top surface 21, in this embodiment is arranged to comprise a first group of strips **21*a* and a second group of strips 21b, the strips being parallel in each group but substantially perpendicular to the strips in the other group. Also, the tension grid 22 comprises two groups of wires 22a and 22b, the wires 22a being parallel to the strips 21a and wires 22b being parallel to the strip 21b whereby wires 22a are substantially perpendicular to wires 22b. The strips 21a, 21b and the wires 22a, 22b may be secured to the circular ring 24** by any suitable means. When they are secured through means for applying tension such as turnbuckles or combination of bolts and nuts, they may be stretched easily.

Figure 2C:
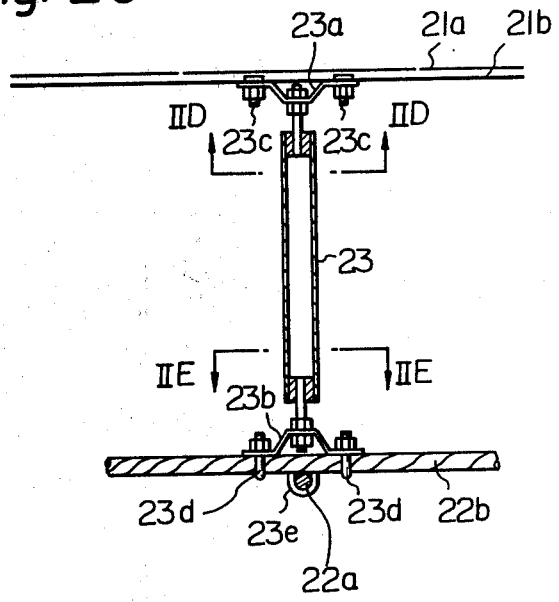
Figure 2D:
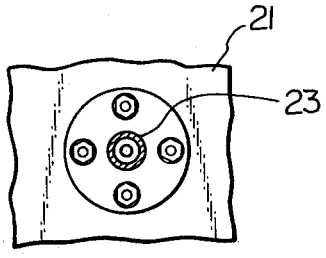
Figure 2E:
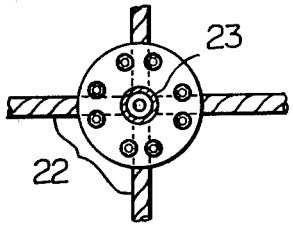

In FIGS. 2C, 2D and 2E, several fragmentary views showing one of the examples for joining the members of the embodiment illustrated in FIGS. 2A and 2B. The intermediate member 23 is shown as a pipe member having stud bolts and nuts at the opposite ends to be coupled with mounting plates 23a and 23b, respectively. The plate 23a is secured to the strip 21b by means of stud bolts and nuts identified by reference 23c, the stud bolts of which may extend through the strip 21b with their heads smoothed so as to facilitate stretching the strip 21a overlying on the strip 21b. The plate 23a may also be attached to the under side of the strip 21b by a suitable adhesive. While in FIG. 2C, the strips 21a are illustrated so as to be disposed side by side, they may be overlapped along the edges. The lower plates 23b are coupled with the crossing wires by means of "U" bolts 23d, 23e and nuts, as shown. By the joining construction illustrated in FIG. 2C, the tension may be applied to the top surface 21 and the grid 22 by adjusting the length of opposite ends bolts and nuts of the intermediate member 23. The roof 21 is supported by, for example, a plurality of columns or posts 25 along the ring as illustrated in FIG. 2B.

Although in the embodiment illustrated in FIGS. 2A through 2E, the roof surface 21 comprises two groups of strips 21a and 21b; it may be constructed by a single group of strips. However, double layered strip construction illustrated and explained in connection with FIGS. 2A through 2E is preferably employed when the boundary frame is symmetrical with respect to the two orthogonal axes of the frame.

In FIGS. 3A through 3D, a third embodiment of the present invention is illustrated. A roof 30 of this embodiment is given a saddle shape and comprises a boundary frame 34, a group of strips 31 and a group of strips 32, the strips 31 substantially transversing the strips 32. In this embodiment, intermediate members are omitted and the strips 31 and 32 effect tension directly on each other.

For installing the strips 31, 32, it is preferable to first dispose the group of strips 31 so that each end of the strips 31 is secured to the frame 34 in a manner approximating the final saddle shape of the roof 30. Then the group of strips 32 is mounted in the frame 34 so that the strips are stretched over the group of strips 31, applying tension on themselves as well as on the strips 31. When the strips 31 and the strips 32 are tensioned enough, the structure of the roof 30 becomes stable. The roof 30 is supported, in a manner similar to that shown in FIG. 3B, by plural columns or posts 35. By the construction of the third embodiment, the intermediate members required in the first and third members are eliminated to transmit the tension on each other between the upper members and the lower members.

Figure 3A:
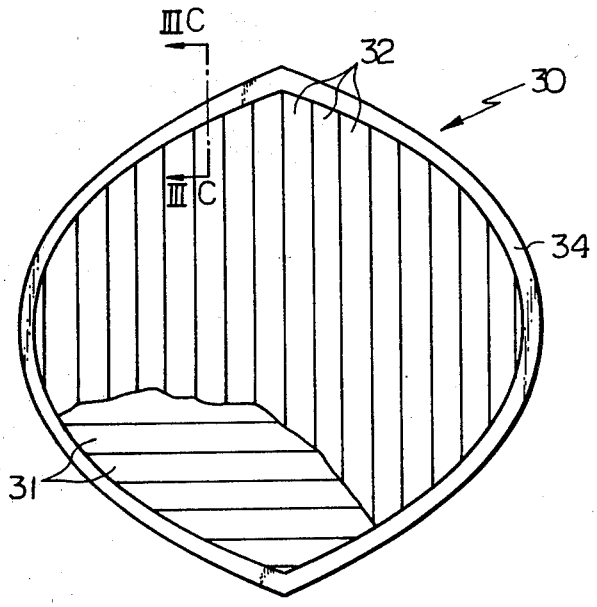
FIGS. 3A and 3B show a third embodiment having a curved surface of a saddle shape in a plan view and a side view, respectively.
Figure 3B:
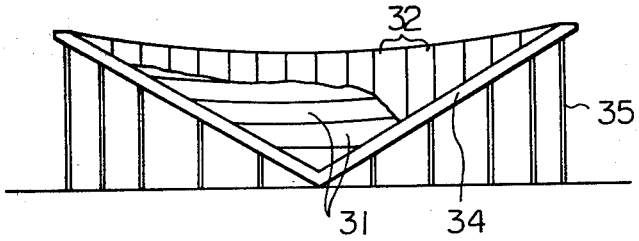
Figure 3C:
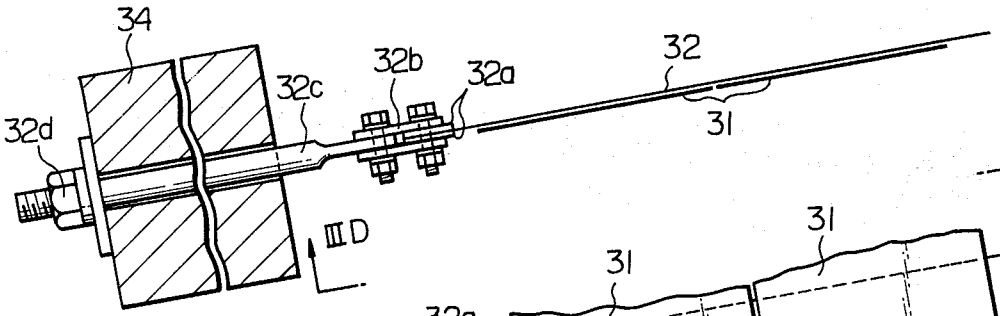
Figure 3D:
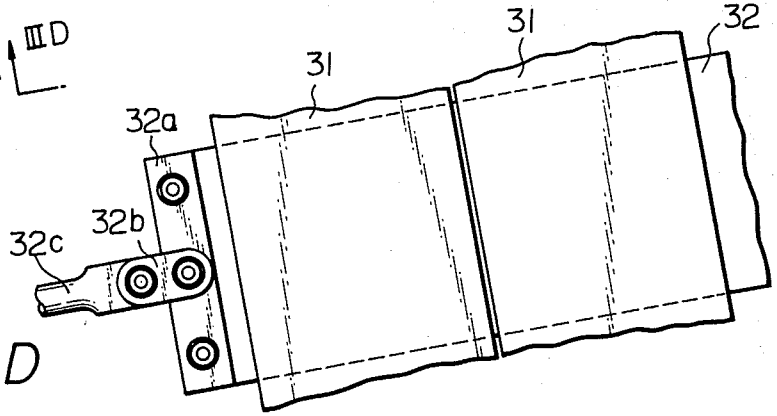

One of the examples of the joining and stretching the end of the strip 32 to the frame 34 is illustrated in FIGS. 3C and 3D. The end of the strip 32 is clamped between a pair of plates 32a and fastened together therewith by a suitable number of bolts and nuts. At the center of the plates 32a, another pair of plates 32b is provided so as to fasten an end rod 32c at the opposite end. The end rod 32c is extended through the frame 34 and arranged to be pulled outwardly by rotating a nut 32d on the rod 32c.

Figure 4:
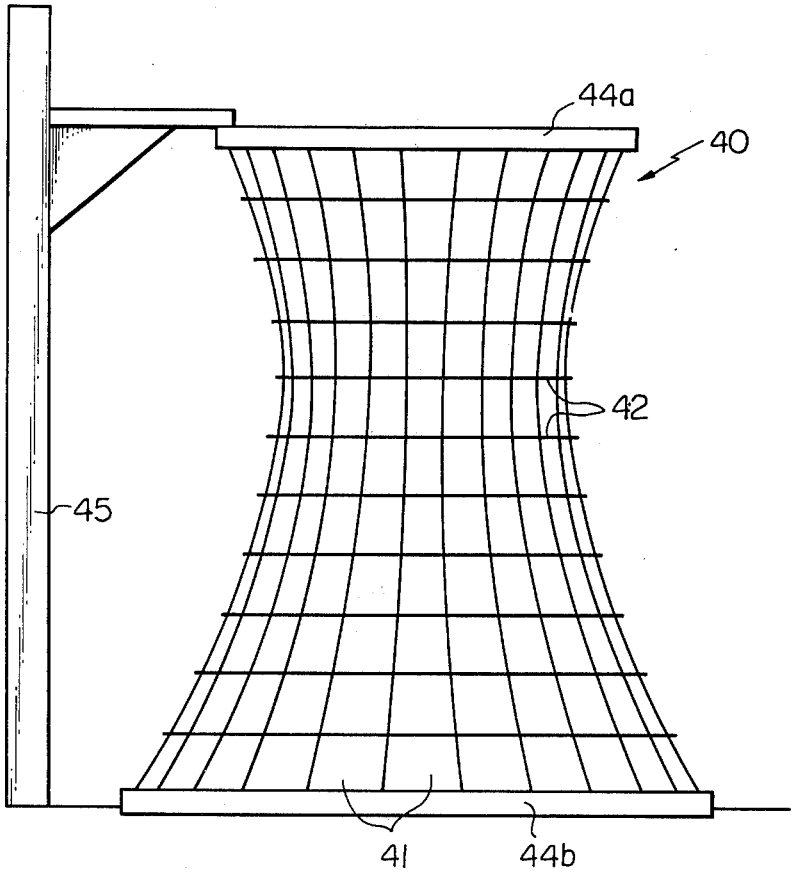
FIG. 4 is a side view of a fourth embodiment of the present invention which is a tower shape.

In FIG. 4, there is shown a tower 40 as a fourth embodiment according to the present invention, the curved surface of which being a hyperboloid of one sheet. In this tower 40, the intermediate members are also eliminated and a group of strips 41 are prestressed. The opposite ends of the strips are secured to an upper frame 44a and a lower frame 44b, respectively. A plurality of concentric rings 42 are disposed on the outerside of the strips 41 so that the rings are in the planes each perpendicular to the vertical axis of the tower 40. The respective diameters of the rings 42 are naturally different to conform to the hyperboloidal surface and retained in the respective positions by suitable retainers, such as fittings on the surface of the strips so as not to be displaced down or up due to the tension applied on the strips 41. There are several ways to apply tension on the strips 41 as well as on the rings 42. For instance, if the upper and lower frames 44a, 44b are initially positioned as shown in FIG. 4 by a post 45 to maintain their relationship, the strips 41 may be easily secured at opposite ends to the frames 44a and 44b leaving slack in each strip. Thereafter, at the respective heights, the rings are tightened properly by such as using turnbuckles until the tensile stress reaches a proper amount in each of the strips 41 which also effects tension on each of the rings 42. Alternatively, the upper frame 44a may be at first placed in a lower position and the strips 41 and the rings are all installed in that position. Then, if the upper frame 44a is raised to a predetermined height, the strips 41 and the rings are stressed. In the construction of the fourth embodiment, the intermediate members are not employed to apply the tension on the strips and the tension members, i.e. the rings in this case.

In the foregoing, the group of members forming the curved surface and the group of tension members are applied with tension mechanically in such a manner that both groups have effect on each other through intermediate members or direct contact therebetween.

In the embodiments hereinafter to be explained, fluid is employed as means for transmitting tension from one group to the other group and vice-versa.

Figure 5A:
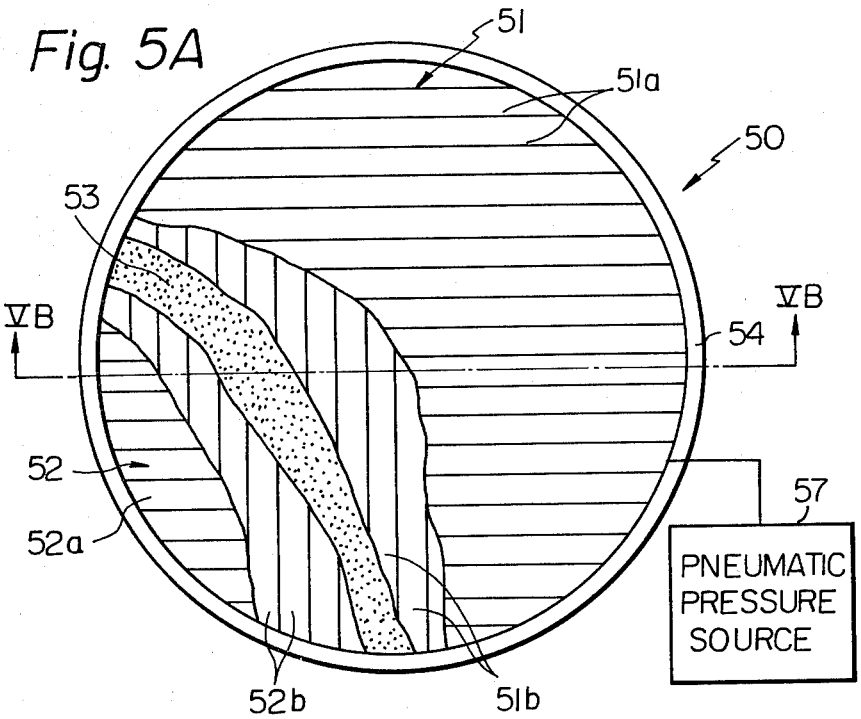
FIGS. 5A and 5B show a fifth embodiment of the present invention in a plan view and a side view, respectively, utilizing pneumatic pressure for tensioning strips.
Figure 5B:
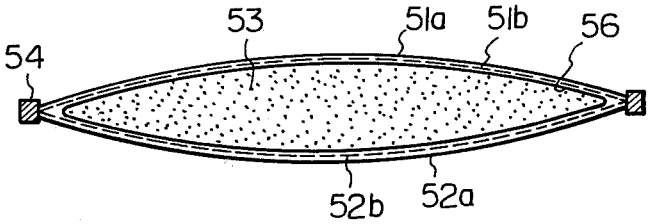

In FIGS. 5A and 5B, a fifth embodiment according to the present invention is illustrated as a roof 50. The construction of the roof 50 is somewhat similar to that of the roof 20 shown and described as the second embodiment of the present invention. The top surface 51 comprises two groups of strips 51a and 51b which are arranged and secured to a boundary frame 54 in a manner similar to that of the top surface 21 of the second embodiment shown in FIG. 2A. The lower surface 52 is constructed in the same way as the upper surface 51 and comprises two groups of strips 52a and 52b. In FIG. 5B, a section of the roof 50 is illustrated. As shown in FIG. 5B, an airtight envelope 56 preferably of synthetic material is disposed and when pneumatic pressure is applied from a pneumatic pressure source 57, such as a blower or compressor, to a space 53 between the surfaces 51 and 52, the space 53 being the inside of the envelope 56 in this case, the envelope 56 is inflated until it substantially and uniformly pushes out the surfaces 51 and 52 to their final shapes and the tension is applied on the strips 51a, 51b and 52a, 52b thereby the roof 50 becomes stable by the pre-stressed strips. The envelope 56 may be eliminated if an appropriate sealing means is applied between the frame and strips and also between each adjacent strip so that the sealing may not interfere with the movement of strips upon applying the pneumatic pressure into the space 53. Such sealing means may be an elastic packings disposed between each of the strips and betwen the frame and the strips. Also, alternatively, if the internal pressure is maintained by constantly supplying compressed air from the source, the envelope 56 or the sealing means may be omitted depending on the overlapping condition of the strips and d the connection at the frame.

As shown in FIG. 5A, the strips 51*a* and 51*b* are arranged parallel in the same group, respectively, but the direction of each group transverses that of the others. This is the same in the groups of the strips 52*a* and 52*b*. However, it will be apparent that there is no need to consider the direction of the groups between the surfaces 51 and 52 for the pneumatic type shown in FIGS. 5A and 5B though the groups of upper surface and the lower surface are illustrated in parallel and orthogonal in FIG. 5A. The structure of the fifth embodiment may be referred to as a pneumatic metal membrane type.

Figure 6:
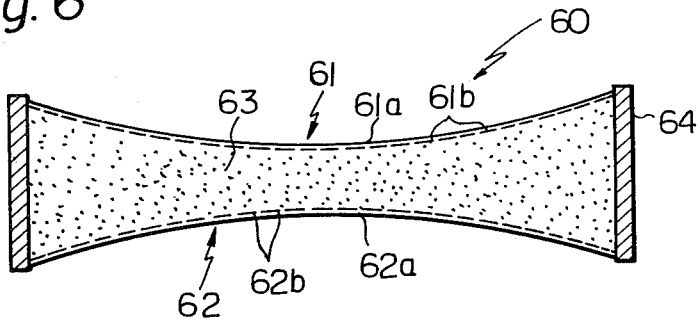
FIG. 6 is a side view of a sixth embodiment of the present invention applying negative pressure (i.e. lower than atmospheric pressure) to the closed space.

In FIG. 6, a sixth embodiment of the present invention which may be a roof 60 of a pneumatic metal membrane type. An upper surface 61 and a lower surface 62 are almost the same as the surfaces 51 and 52 in construction, respectively. For instance, the upper surface 61 comprises two groups of strips 61*a* and 61*b* orthogonally arranged with respect to each other and the lower surface 62 comprises two groups of strips 62*a* and 62*b* also orthogonally arranged each other. However, they are mounted on a frame 64 having a certain height as shown in FIG. 6. In this embodiment, the portions between the adjacent strips are sealed and the portions connecting the strips to the frame are also sealed so as to make an inside space 63 of the roof 60 airtight. When the inside space is connected to a vacuum source, i.e. if the inside pressure is lowered below the atmosphere pressure, the strips in the upper and lower surface are tensioned thereby stabilizing the shape and rigidity of the roof 60. If the negative pressure of the inside space 63 is constantly maintained by using such as a vacuum pump, the sealing touched upon above may be partially or entirely eliminated. In this case also, fluid under negative pressure within the space 63 serves as an intermediate medium to transmit the force between the group of upper strips and the group of lower strips.

Figure 7A:
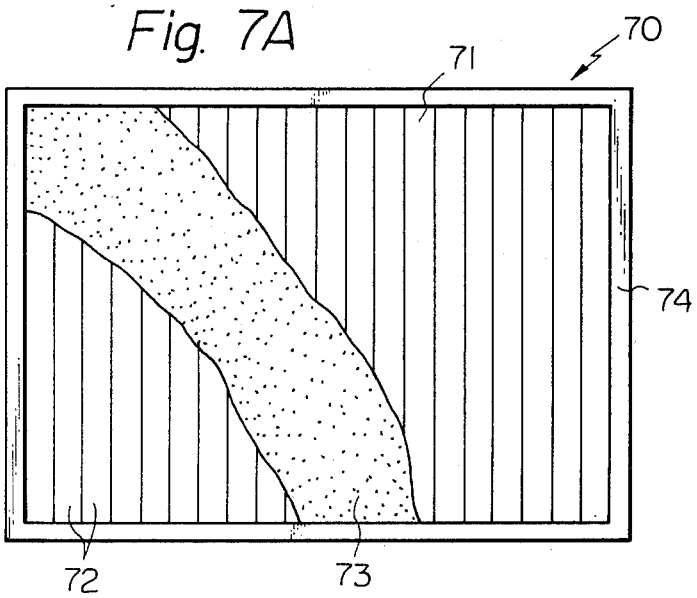
FIG. 7A is a plan view of a seventh embodiment of the present invention similar to the fifth embodiment but having a rectangular plan.

A seventh embodiment of the present invention is illustrated as a roof 70 having a retangular shape as illustrated in FIG. 7A. In this embodiment, a group of strips 71 forming the upper surface and a group of strips 72 forming the lower surface are arranged to be parallel to the shorter edge of the rectangular shape. If the frame is square, the upper strips and the lower strips may be orthogonally arranged with respect to each other. Further, in such case, the upper surface may be constructed as a double layer similar to that shown in FIG. 2A or FIG. 5A. Also, in FIG. 7B, a modification of the roof 70 is illustrated as a roof 70' the four corners of which are trimmed off. This trimming makes it easy to employ a double layered surface in the upper and lower portions, respectively. The same reference is given to the members similar to that shown in FIG. 7A except with the adding prime thereto, respectively and the double layered strips are given additional reference "a" and "b" in a similar way to that shown in FIG. 5A. In the roof 70', the direction of the strips may be made in orthogonal arrangement as shown.

Figure 8A:
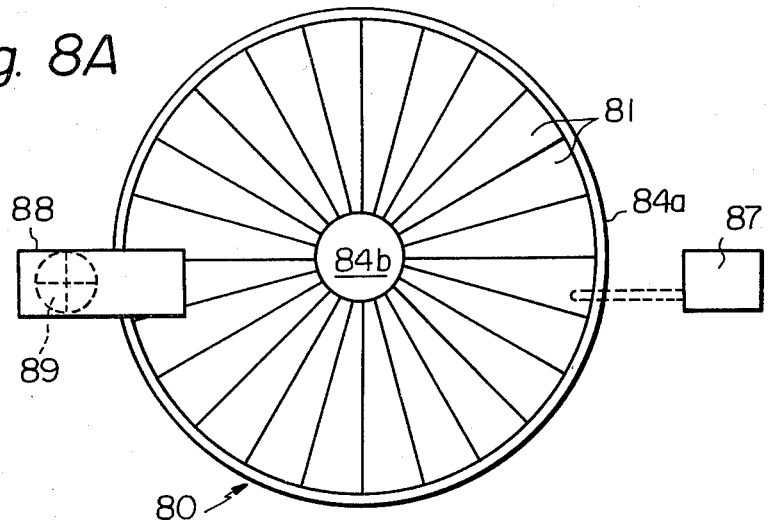
FIGS. 8A and 8B show an eighth embodiment of the present invention having a spherical surface in a plan view and a side view, respectively.
Figure 8B:
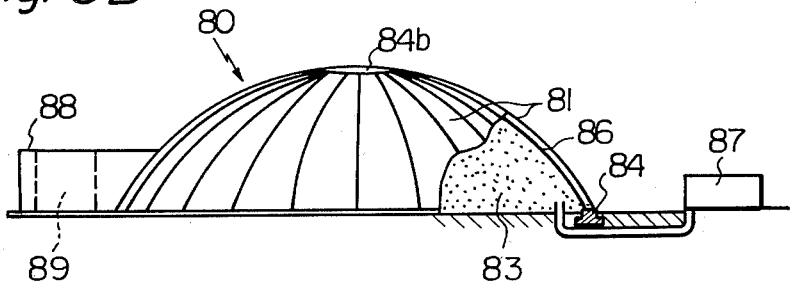

FIGS. 8A and 8B show an eighth embodiment of the present inventon in a plan view and a side view, respectively. This embodiment is also of a pneumatic metal membrane type constructed as a part of spherical shape.

Figure 8C:
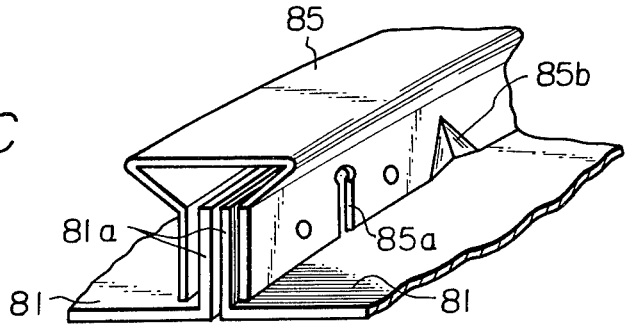
FIG. 8C is a fractional perspective view showing a mechanical means for connecting adjacent strips in the eighth embodiment.

In this spherical structure 80, each of the strips 81 is joined at the opposite ends to a circular ground member 84*a* and a top disk member 84*b*, respectively, so that a group of strips 81 are radially arranged as shown in FIG. 8A. Before applying the internal pressure, the structure may be laid down in nearly flat state on the ground due to the thinness of the strips 81. While in such state, there is preferably disposed an airtight membrane 86 underside the structure 80, the membrane being suitable to conform to the shape of the erected structure 80. With the arrangement above, each of the strips 81 is stressed substantially in the longitudinal direction thereof to stabilize the structure when the membrane 86 is gradually inflated by applying pneumatic pressure from the source 87 such as a blower or compressor. The longitudinal edges of the strips 81 may be mechanically joined with the edges of the adjacent edges. Such mechanical means is illustrated in FIG. 8C. The opposite edges of the strip 81 are provided with upright flanges 81*a*, respectively, and the adjacent flanges 81*a* are brought together over which a preformed stringer member 85 is placed to sandwich the two flanges 81*a* and fastened together by means of bolts or rivets.

Since the surface of the completed structure 80 is given a curvature resembling part of a sphere, the stringer member may be given cutouts 85*a* or wrinkles 85*b* with an appropriate pitch along the longitudinal direction thereof so that the stringer easily conforms to the completed shape of the structure. The stringers 85 may be installed to the structure after the internal pressure is applied; however, they may be installed when the structure is in a nearly flat state preferably around the central data thereof before applying the pneumatic pressure, since such preinstallation saves necessity of a huge scaffold. In the range such as easily accessible from the ground, the installation of the stringers 85 is preferably effected after the structure is pressurized and stabilized. The stringer 85 may be prepared in a suitable length and extended to a desired length by longitudinally joining two or more. The connection between the disk 84*b* and the strips 81 may be made similar to that illustrated in FIG. 8C by providing the upright flanges for the both.

At the time of installing the mechanical joining means such as illustrated in FIG. 8C, sealing material may be applied to the mating surfaces of the flanges 81*a* and/or between the flanges 81*a* and the stringer 85. The stringer 85 may be replaced with a flexible tape. If this sealing material is applied, the membrane 86 may be removed after erection is completed.

The structure 80 is conveniently provided with a gate 88 in which a movable barrier is preferably arranged to maintan the internal pressure while permitting going in and out. An example of such barrier is a revolving door 89 or at least two doors arranged in series in the passage through the gate for alternatively opening and closing the gate 88.

The ground frame may be made of reinforced concrete with suitable fittings to connect the ends of the strips 81.

In the foregoing explanation, the membrane 86 is explained as means for inflating the structure to its final shape and tensioning the strips even though the membrane may be removed. However, the membrane is not necessarily required. For instance, if the sealing means is applied to the portions of the structure such as along the adjacent longitudinal edges of the strips and the portions connected to the disk 84*b* and the ground frame 84*a*, the membrane may be unnecessary. Such sealing may be accomplished by applying deformable sealing material such as rubber, plastic material or the like at the respective junctions of the members concerned.

The sealing referred to above may preferably be omitted partially or entirely if the capacity of the pressure source is enough to maintain the internal pressure. This may also enable to eliminate a ventilation system which is required in case the sealing is perfect and the inside space is utilized by human beings.

The strips 81 radially mounted may also overlap each other along the longitudinal edges. Also, the shape of the structure is explained as a part of a sphere; however, it is not limited to geometrical sphere but includes a structure having a curved surface somewhat resembling the spherical surface.

Figure 7B:
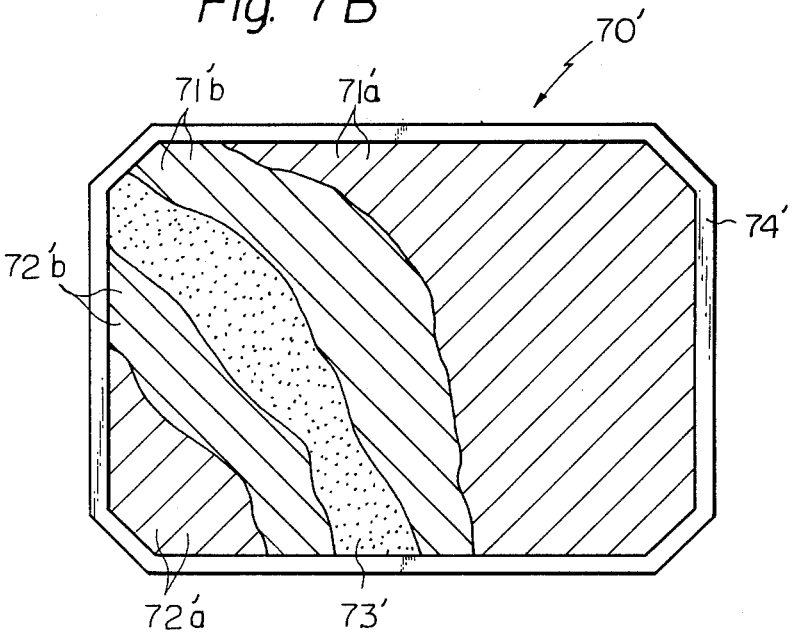
FIG. 7B is a plan view of modification to the seventh embodiment shown in FIG. 7A.

In the structure 80, the ground surface serves as a member equivalent to a tension member of members explained regarding the embodiments shown in FIGS. 5A, 7A and 7B.

The shape of the structure 80 explained referring to FIGS. 8A and 8B, is briefly explained as part of a sphere or similar shape. In the structure 80, the prestress applied to each of the strips is substantially the tension in the longitudinal direction thereof. However, if it is desired to apply tension absolutely only in the longitudinal direction, the curve of such surface is attained by arranging the shallowness ratio (λ) of the curved surface to be minimum. That is, such condition satisfying the curved surface of revolution (which is free of wrinkles) in the pneumatic membrane structure is expressed by $$\lambda = \frac{\int_0^{\pi/2} r_1 \sin \phi d\phi}{\int_0^{\pi/2} r_1 \cos \phi d\phi} \longrightarrow \min.$$

wherein $r_1$ is a first primary radius of curvature of the curved surface; and $\phi$ is an angle between the axis of rotation and the normal to the surface.

It was proved by the inventor of the present invention that only one "λ" exists to satisfy the above condition which is expressed by the following:

$$\lambda = \frac{\sqrt{\pi}\,\Gamma(\frac{3}{4})}{4\,\Gamma(5/4)} = 0.5991$$

wherein Γ is a Γ function.

(Bulletin of International Association for Shell and Spatial Structures, No. 63, 1977)

The surface satisfying the above condition is not available as an analytically explicit form but it is given by answers in numerical values.

Figure 8D:
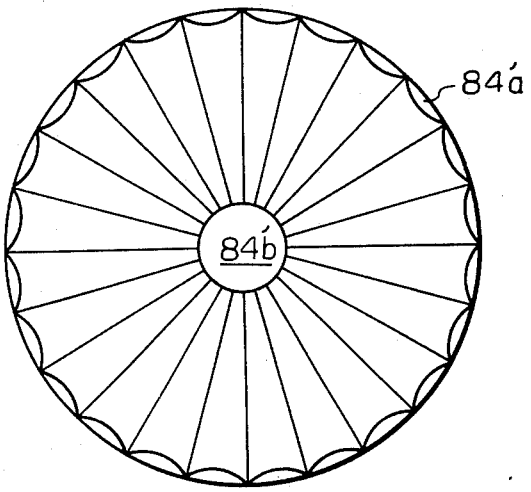
FIGS. 8D and 8E show a plan view and a side view of modification to the eighth embodiment shown in FIGS. 8A and 8B.
Figure 8E:
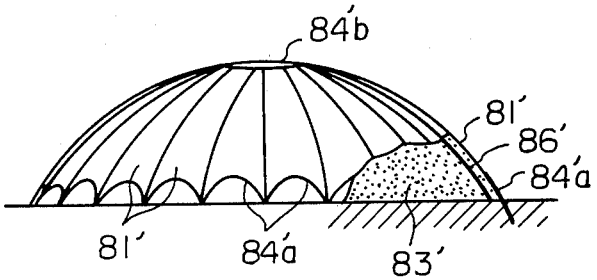

A modification of the spherical structure 80 is illustrated in FIGS. 8D and 8E as a spherical structure 80′ and the same reference as that given to each of the similar members of the structure 80 is given in this modified structure 80′ with the addition of prime thereto, respectively. Since the functions of the members are the same as those without prime in the structure 80, further explanation is omitted except for the ground frame member 84*a*′. In this case, the frame member may be a wire, rope, metal rod, metal tube, metal sheet, etc. and this member is anchored in the ground where it contacts the same. Therefore, the completely circular reinforced concrete may be replaced with anchors arranged at an appropriate interval. In this construction, some skirt member sealing the inside space may be necessary.

A gate may be provided similarly to that shown in FIGS. 8A and 8B.

Figure 8F:
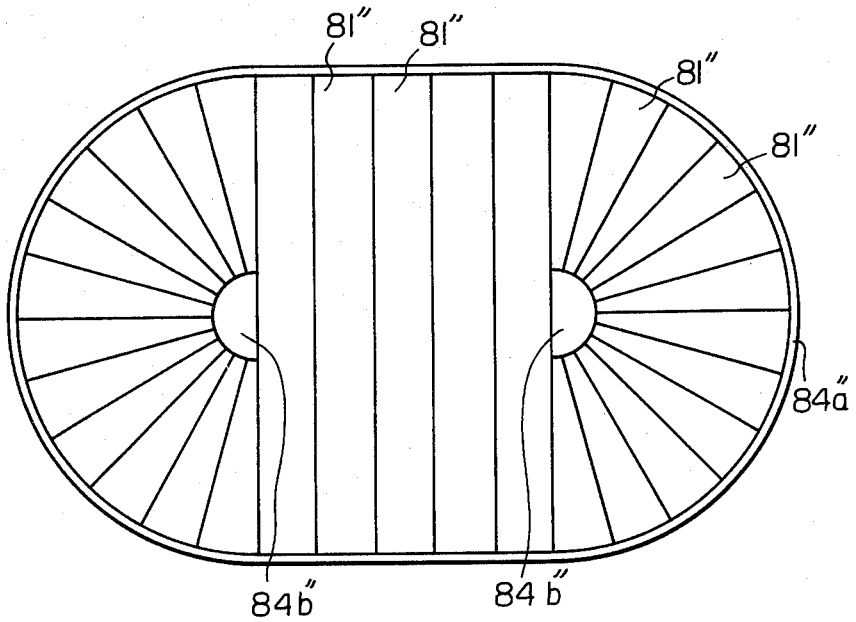
FIGS. 8F and 8G show a plan view and a side view, respectively, of further modification to the eighth embodiment shown in FIGS. 8A and 8B.
Figure 8G:
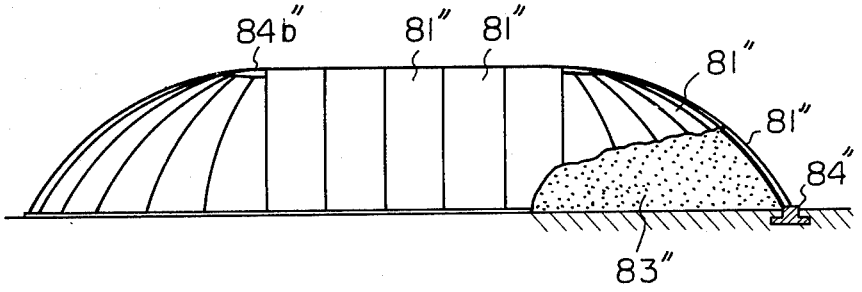

In FIGS. 8F and 8G, a structure 80″ comprising spherical portions and a cylindrical portion is illustrated. The system for constructing the structure and applying the internal pressure is substantially the same as the structure 80 or 80′ explained above except for a ground frame 84*a*″ which is formed in an oval shape having a pair of parallel side portions at the center thereof and a semicircular portion at the opposite ends and strips are different in shape at the center and the ends, so further detailed description is omitted and the same reference is given to each of the members with addition of the double prime, respectively as those in FIGS. 8A, 8B and 8D, 8E through the strips 81″ are given different shapes at the opposite ends and the center portions.

As explained in the above, the present invention provides several structures utilizing metal sheets as their important members in the form of strips substantially as they are produced or requiring only slight trimming or forming, so the cost in construction is greatly reduced in combination with other advantages such as no necessity for a large scaffold. Also, the metal strips may be joined or may not be joined each other. In joining them, other means not specifically explained hereinabove such as welding, rivetting may be used.

In the practical application of the metal strips, the material, width and the thicknesses are determined depending on the using condition, climate of the place where the structure is erected, size of the structure and economical availability of the strips in the market. For instance, the thickness may range from under 1.0 m/m to 10 m/m. In the spherical structure shown in FIG. 8A, if the diameter is approximately 10 meters, the thickness of the strips would be 0.3 m/m and it increases to 10 m/m when the diameter reaches 200 m. These dimensions are only for examples.

The invention has been explained in detail referring to the specific embodiments, however, the invention is not limited to those explained and the modification and changes would be readily available to those skilled in the art within the spirit and scope of the invention defined in the appended claims.

For example, an insulation layer may be applied on the inner surface of the metal strips to provide temperature isolation between outside and inside of the structure. Such insulation layer may be applied when the strips are flat or after the erection is over.

I claim:

1. A tension structure comprising:

a boundary means;

a group of elongated metal strips arranged side by side substantially without means for transmitting force between the adjacent strips, each thereof being secured at opposite ends in a longitudinal direction thereof to said boundary means; and means for applying tension to each of said metal strips substantially only in said longitudinal direction to form a stabilized continuous curved surface by said strips, said means including:

a group of tension members having a curvature opposite to that of said curved surface; and a plurality of intermediate members disposed between said metal strips and said tension members;

said metal strips and said tension members effecting tension on each other through said intermediate members.

2. A tension structure comprising:

a boundary means;

a group of elongated metal strips arranged side by side substantially without means for transmitting force between the adjacent strips, each thereof being secured at opposite ends in a longitudinal direction thereof to said boundary means; and means for applying tension of each of said metal strips substantially only in said longitudinal direction to form a stabilized continuous curved surface by said strips, said means including another group of metal strips opposing said first group to provide a space therebetween and pneumatic pressure applied to said space, said strips in both groups being partially overlying each other at their longitudinal edges.

3. A tension structure as claimed in claim 2 wherein said strips in each of the two groups are arranged to form are arranged in two layers, the strips in each layer being arranged to be parallel but orthogonal to the strips in the other layer.

4. A tension structure comprising:

a boundary means;

a group of elongated metal strips arranged side by side substantially without means for transmitting force between the adjacent strips, each thereof being secured at opposite ends in a longitudinal direction thereof to said boundary means; and means for applying tension to each of said metal strips substantially only in said longitudinal direction to form a stabilized continuous curved surface by said strips, said means including another group of metal strips opposing said first group to provide a space therebetween and pneumatic pressure applied to said space, sealing being applied between the adjacent strips in the same group, respectively, and the portions where the ends of said strips are secured to said boundary means.

5. A tension structure having a curved surface which is of a shape comprising entirely or partially a curved surface of revolution the axis of which is vertical, said structure comprising:

a boundary means including a ground frame of a closed figure and a circular or semi-circular disk of sheet metal the center of which is disposed coaxially with said axis of revolution, a group of elongated metal strips arranged side by side substantially without means for transmitting force between the adjacent strips, each of the strips forming said surface of revolution being radially disposed around said axis between said disk of sheet metal and said ground frame and secured to said ground frame at one end and to said disk of sheet metal at the other end, each of the strips forming the portion other than said surface of revolution being secured at opposite ends thereof to said ground frame, and pneumatic pressure means for applying tension to each of said metal strips substantially only in said longitudinal direction by introducing pneumatic pressure inside between the curved surface and the ground surface to form said curved surface as a stabilized continuous curved surface.

6. A tension structure as claimed in claim 5 wherein said surface of revolution is of such shape as satisfying the following equation:

$$\lambda = \frac{\int_0^{\pi/2} r_1 \sin \phi d\phi}{\int_0^{\pi/2} r_1 \cos \phi d\phi} \longrightarrow \min$$

wherein $\lambda$ is a shallowness ratio:

$r_1$ is a first primary radius of curvature of the curved surface; and $\phi$ is an angle between the axis of revolution and the normal to the surface.

7. A tension structure as claimed in claim 6 wherein said $\lambda$ is given the following value;

$$\lambda = \frac{\sqrt{\pi}\,\Gamma(\frac{3}{4})}{4\,\Gamma(5/4)} = 0.5991$$

wherein $\Gamma$ is a $\Gamma$ function.

8. A tension structure as claimed in claim 5 wherein said strips partially overlap each other between the adjacent ones at the respective longitudinal edges.

9. A tension structure as claimed in claim 5 wherein sealing is applied to the portions between the adjacent strips and between the ends of the strips and said frame so as not to transmit lateral force to each other between the adjacent strips.

10. A tension structure as claimed in claim 5 wherein said frame is constructed to have two parallel side portions provided with circular curves at the opposite ends of said side portions to complete the closed figure, said strips comprising radially arranges trips at said opposite ends and strips arranged in parallel to each other but normal to said side portions, said strips being formed to have a complex curved surface of cylindrical shape at the parallel side portions and spherical shapes at opposite ends when pneumatic pressure is applied to a space between the strips and the ground surface.

11. A tension structure as claimed in claim 5, wherein a flexible membrane or envelope is disposed inside of the structure, the shape and size of said membrane or envelope being such that when pneumatic pressure is applied, said membrane or envelope is inflated to inscribe the metal strips formed to have said curved shape.

12. A tension structure as claimed in claim 11 wherein sealing is applied at the longitudinal edges of the strips between the adjacent ones and at the ends secured to said boundary means, said membrane or envelope being arranged to be removable after the pneumatic pressure is applied to fully tension the respective strips.

* * * * *